US006557962B2

(12) United States Patent
Hoisington et al.

(10) Patent No.: US 6,557,962 B2
(45) Date of Patent: May 6, 2003

(54) INK JET PRINTING

(75) Inventors: Paul A. Hoisington, Norwich, VT (US); Marc A. Torrey, Amstelveen (NL)

(73) Assignee: Spectra, Inc., Lebanon, NH (US)

( * ) Notice: Subject to any disclaimer, the term of this patent is extended or adjusted under 35 U.S.C. 154(b) by 0 days.

(21) Appl. No.: 09/927,953

(22) Filed: Aug. 10, 2001

(65) Prior Publication Data

US 2002/0067383 A1 Jun. 6, 2002

Related U.S. Application Data

(63) Continuation-in-part of application No. 09/637,799, filed on Aug. 11, 2000.

(51) Int. Cl.[7] ..... B41J 29/38
(52) U.S. Cl. ..... 347/12; 347/11
(58) Field of Search ..... 347/12, 10

(56) References Cited

U.S. PATENT DOCUMENTS

| | | | | |
|---|---|---|---|---|
| 5,790,139 A | | 8/1998 | Umeno et al. | 347/10 |
| 5,984,464 A | | 11/1999 | Steinfield et al. | 347/87 |
| 6,257,689 B1 | | 7/2001 | Yonekubo | 347/11 |
| 6,259,463 B1 | * | 7/2001 | Askeland et al. | 347/15 |
| 6,276,773 B1 | * | 8/2001 | Takizawa | 347/10 |
| 6,428,134 B1 | * | 8/2002 | Clark et al. | 347/10 |

FOREIGN PATENT DOCUMENTS

| | | | |
|---|---|---|---|
| EP | 0827838 A2 | 11/1998 | B41J/2/27 |

* cited by examiner

*Primary Examiner*—Huan Tran
*Assistant Examiner*—Alfred E Dudding
(74) *Attorney, Agent, or Firm*—Fish & Richardson P.C.

(57) ABSTRACT

During a print cycle, fire pulses of different profiles are delivered to ink-jets of a print head. Selected ones of the ink-jets are enabled in coordination with the occurrence of selected ones of the fire pulses to control a characteristic of drops that are jetted by the respective ink-jets.

27 Claims, 3 Drawing Sheets

INK JET PRINTING

Figure 1:
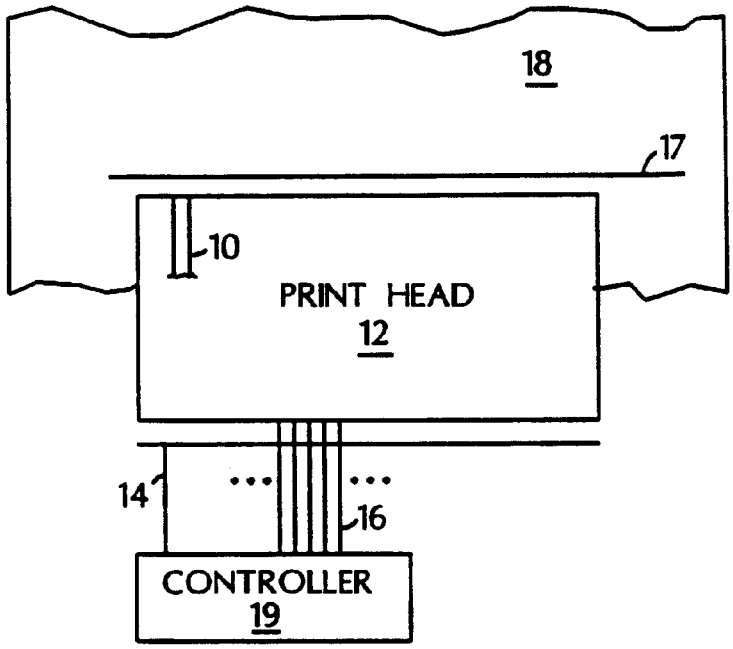

This application is a continuation-in-part of U.S. application Ser. No. 09/637,799, filed Aug. 11, 2000, the entire contents of which is incorporated herein by reference.

This invention relates to ink-jet printing.

In drop-on-demand ink-jet printing, for example, a particular print head may have 256 jets in four groups of 64 jets each. The four groups are formed in four respective pieces of piezoelectric material.

Printing occurs in print cycles. In each print cycle, a fire pulse (say, 150 volts) is applied to all of the 256 jets at the same time and enabling signals are sent only to those of the jets that are to jet ink. In some print heads, the ink jet orifices are aligned in a row, and a print cycle corresponds to a print line.

The volume of the drop of ink that is produced by the fire pulse depends on the properties of each ink-jet. Some applications, such as printing color films for liquid crystal display (LCD) panels, require a degree of uniformity of the drop volume sizes applied by the ink-jets.

One way to cause the ink-jets to have uniform drop volumes is to trim or offset the common fire pulse voltage by an appropriate amount at each ink-jet. Another approach is described in U.S. patent application Ser. No. 5,790,156.

SUMMARY

In general, in one aspect, the invention features, during a print cycle, delivering fire pulses of different profiles to ink-jets of a print head, and enabling selected ones of the inkjets in coordination with the occurrence of selected ones of the fire pulses to control at least one characteristic of drops that are jetted by the respective ink-jets.

Implementations of the invention may include one or more of the following features. The selected ones may be all or fewer than all of the ink-jets in the print head. The fire pulses of different profiles may be delivered in sequence, and the same sequence may be repeated in successive print cycles. The profiles may differ in voltage and/or in duration. The characteristic of the drops that is controlled may include the drop volume and/or the drop velocity. The pulses and ink-jets may be selected to cause the volumes (and/or velocities) of drops jetted by the ink-jets in the line to be essentially uniform. The substrate may be a film that is to be incorporated into an LCD panel. In various aspects, the invention features enabling selected ones of the ink-jets in coordination with selected ones of the fire pulses in a manner that said selected ink-jets are enabled during multiple fire pulses within a print cycle.

In general, in another aspect, the invention features apparatus that includes a print head having ink-jets, and a controller coupled to the print head and configured to (a) deliver fire pulses of different profiles to ink-jets of a print head in a print cycle, and (b) enable selected ones of the ink-jets in coordination with the occurrence of selected ones of the fire pulses to control at least one characteristic of drops that are jetted by the respective ink-jets.

In general, in another aspect, the invention features a method in which (a) a substrate is positioned at successive locations relative to a print head having ink-jets for printing in a corresponding succession of print cycles, (b) during each print cycle, fire pulses of different profiles are delivered to ink-jets of a print head, and (c) selected ones of the ink-jets are enabled in coordination with the occurrence of selected ones of the fire pulses to control at least one characteristic of drops that are jetted by the respective ink-jets.

In general, in another aspect, the invention features a method in which (a) values of a characteristic of drops jetted by an ink-jet in a print head are associated with different profiles of fire pulses that yielded the drops, and (b) respective ink-jets are controlled to jet drops having desired values by selecting different profiles of a fire pulse within a print cycle.

In another aspect, the invention features a method of controlling grayscale, including during a print cycle, delivering fire pulses of different profiles to ink-jets of a printhead, the different profiles being associated with different ink volumes jetted by said ink-jets. The fire pulses are selected according to desired grayscale level by determining the cumulative ink volume resulting from multiple fire pulses. Selected ones of the ink-jets are enabled in coordination with the occurrence of the fire pulses to control the ink volume that is jetted by the respective ink-jets during the print cycle.

In another aspect, the invention features an apparatus including a printhead having ink-jets, and a controller coupled to the printhead and configured to (a) deliver fire pulses of different profiles to multiple ink-jets of a printhead in a print cycle, said different profiles being associated with different ink volumes jetted by said ink-jets, (b) select a set of said fire pulses corresponding to said desired grayscale levels by determining the cumulative ink volume resulting from multiple fire pulses, and (c) enable selected ones of the ink-jets in coordination with the occurrence of one or more of the fire pulses in the set to control the ink volume jetted by the respective ink-jets during the print cycle.

Implementations may include one or more of the following. The ink volume for multiple jets is determined as a function of pulse profile. The jets are sorted into a group of common grayscale level and enabling said group during common fire pulses. The drop volume difference between jets in said group is about ±10% or less. At least three fire pulses are delivered. At least two fire pulses are enabled.

The aspects are preferably used to control drop uniformity between jets by determining the drop volume or other characteristic for each jet as a function of fire pulse profile and controlling them accordingly to fire droplets of substantially equal volume or other characteristics. The control may include enabling multiple pulses to fire multiple drops from a given jet during a print cycle. In addition, the drop volume control can be used to adjust and control grayscale of an image. For example, the cumulative ink volume from multiple pulses can be determined and the range and resolution of the grayscale can be enhanced.

Other advantages and features will become apparent from the following description and from the claims.

DESCRIPTION

FIGS. 1, 2, 3, 4 illustrate features of some implementations of the invention.

As shown in FIG. 1, individual jets 10 of a print head 12 are driven by fire pulses 14 and enabling signals 16 that permit individual control (by a controller 19) of the volumes of the drops that are jetted by the respective jets during a print cycle. Ink jetted by the ink-jets can be delivered to form print lines 17 on a substrate 18.

Figure 2:
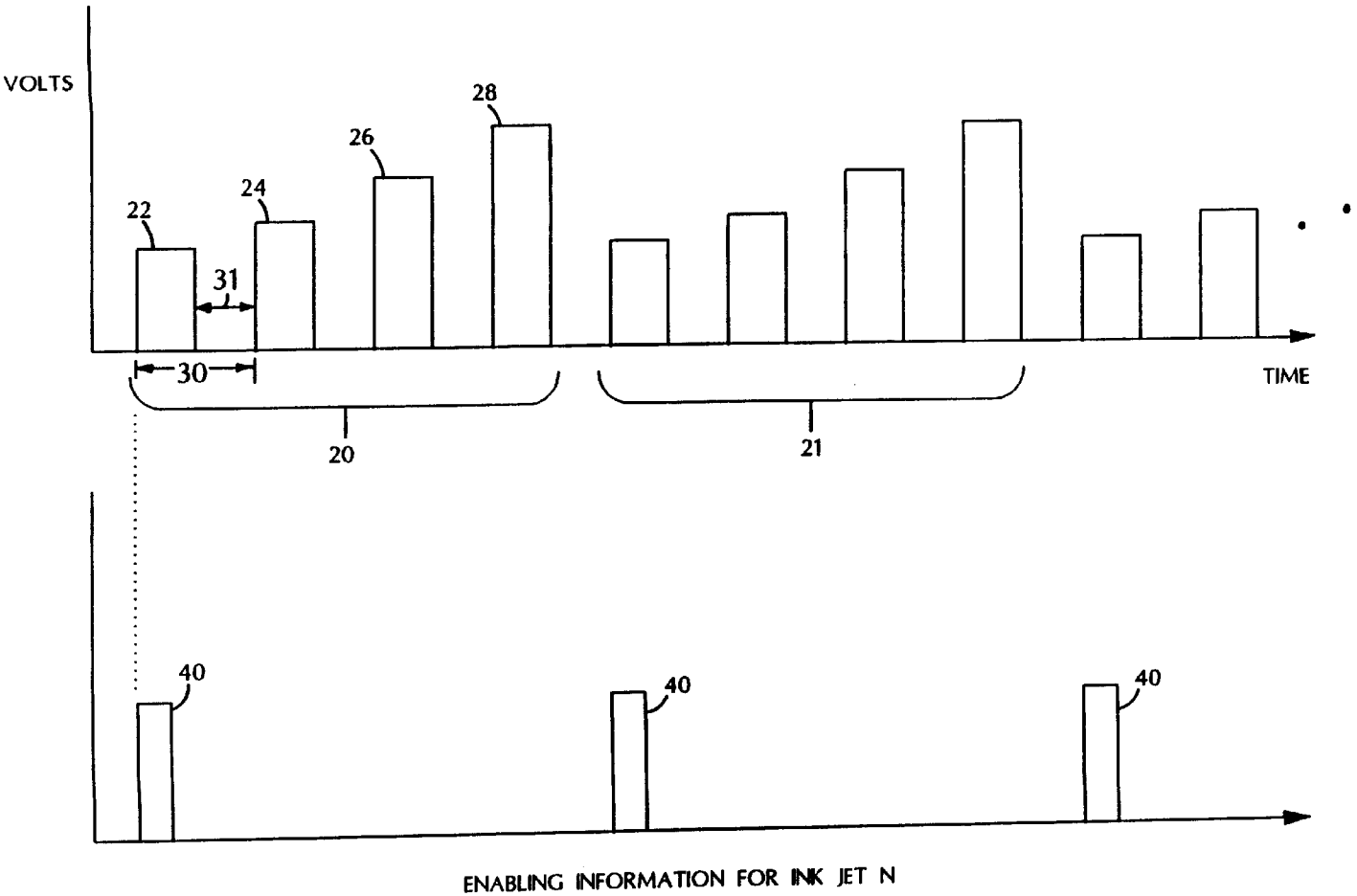

As shown in FIG. 2, a series of print cycles 20, 21, . . . is repeated and the substrate 18 is moved slightly for each new print cycle. Each print cycle has a series of sub-cycles 30. Each sub-cycle contains a predefined fire pulse 22, 24, 26, 28. Each fire pulse is followed by a non-pulse period 31.

The fire pulses in different sub-cycles within a cycle have different profiles. The different profiles are defined to achieve different drop volumes when applied to an ink-jet. All of the fire pulses in a cycle are applied to all of (or a group of) the ink-jets during the cycle.

Enabling information 40 is also applied to each ink-jet during each of the sub-cycles. (Only the enabling information for the Nth ink-jet are shown in FIG. 2.) The enabling information can be downloaded as a bit sequence to a register on the print head and used to precondition each of the jets either to jet or not depending on the value of the bit associated with each of the jets. Thus, the controller can selectively trigger any of the fire pulse profiles for each of the ink-jets for each of the print cycles.

Because the fire pulse profile determines the drop volume for a given ink-jet, the drops applied in a print cycle can be controlled to have (in the example of FIG. 2) one of four different volumes for each ink-jet.

One use of this arrangement is to control the ink-jets of a print head to deliver essentially uniform drop volumes in each print cycle. To achieve that result does not necessarily mean using the same fire pulse profile for all of the jets, because different jets have different electromechanical, thermal, and fluid-dynamic characteristics.

The drop volumes that are produced by each ink-jet for each of the different fire pulse profiles can be determined empirically prior to printing. The ink-jets are then assigned to respective fire pulse profiles that will yield the same (or roughly the same) drop volumes. By increasing the number (granularity) of different fire pulse profiles that appear in a given print cycle, the uniformity of drop volume can be enhanced. However, the more fire pulses that must appear in each print cycle, the more time it takes to complete a print cycle.

The profiles of the fire pulses in FIG. 2 are trapezoidal or have exponential rises and falls, and they differ in magnitude (height). In a particular example, there could be five fire pulse profiles having the voltages listed in the following table, with the corresponding indicated drop masses for two different jets. In this example, if the desired drop mass were 80 nanograms, jet 1 would be triggered with a 102-volt pulse and jet 2 would be triggered with a 97-volt pulse.

| Fire pulse voltage | Drop mass in nanograms, jet 1 | Drop mass in nanograms, jet 2 |
|---|---|---|
| 107 | 84.8 | 90.6 |
| 102 | 79.6 | 85.0 |
| 97 | 74.6 | 79.8 |
| 92 | 69.7 | 75.2 |
| 87 | 64.7 | 70.2 |

The pulsing arrangement can be implemented easily in software without requiring any changes to the print head or other hardware. The same pulses can be delivered to all inkjets at the same time; yet different jets can deliver different volumes of drops.

In some applications, for example, when printing images, it can be important to assure that the drops that are jetted in a given print cycle all reach the substrate at the same time. Otherwise, because of the continuous movement of the substrate, pixels of the image that are intended to be in a straight line, will not actually print in a straight line.

Figure 3:
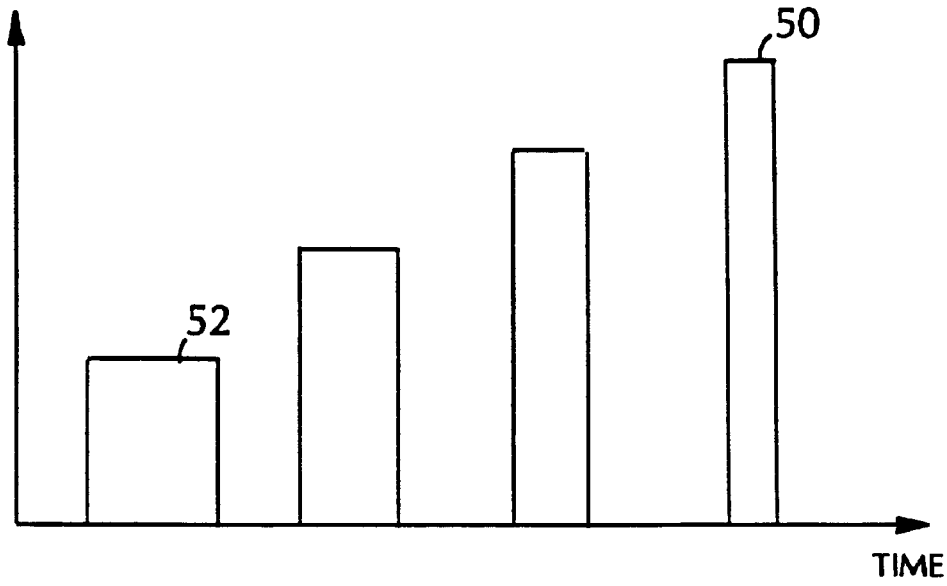

As shown in FIG. 3, to assure that the drops all reach the substrate at the same time, the sequence of fire pulse profiles can be modified so that later pulses in a print cycle are shorter in duration than earlier pulses. Typically, reducing the pulse width will increase the drop velocity for a given drop volume. Therefore the drop triggered by the final profile 50 will have a higher velocity than the drop triggered by the first profile 52 even if the pulses are selected to produce the same drop volume. Because of the difference in velocity, the two drops will reach the substrate at the same time.

Other implementations are within the scope of the following claims. For example, the profiles of the fire pulses can vary in duration and need not be trapezoidal or exponentially rising or falling. For example, they could be sawtooth, or multiple, or bipolar. Any profile that can achieve a desired drop volume can be used. The characteristic of the ink drops that is being controlled can be something other than volume, for example, velocity. The drop characteristic need not be controlled to be uniform in a print cycle. Instead, each ink-jet, or groups of them, could be controlled to have a desired different characteristic in a print cycle. A similar approach can be used to counteract the variation in drop volume associated with the "first drop out" phenomenon in ink-jet printing. The substrate that is being printed may be a film used to make an LCD panel. In this application, all of the jets of the print head are fired in every print cycle.

Figure 4:
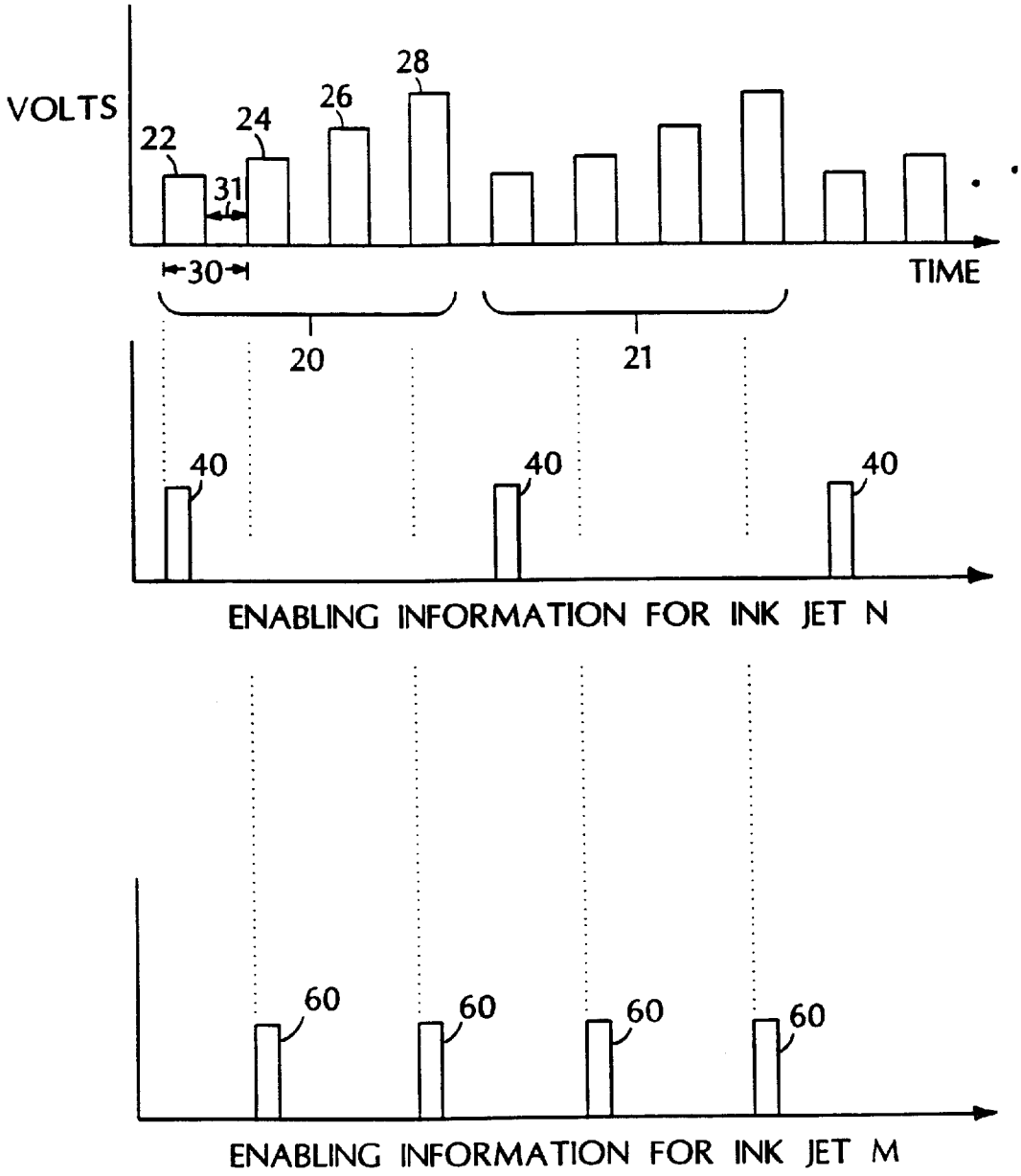

Referring to FIG. 4, as in FIG. 2 above, to produce a certain total drop volume (or mass) from ink-jet N, the ink-jet is enabled 40 during only a single select pulse associated with the desired drop volume. Another ink-jet, ink-jet M, on the other hand, may be enabled 60, 61 during multiple pulses resulting in multiple jet firings during the print cycle. The total ink volume jetted from ink-jet M is thus the sum of the drop volume from the multiple firings. As a result, the range as well as the precision of the drop volume variation can be enhanced, which can be used to enhance grayscale variation.

For example, if a printhead can produce 10, 20, and 40 nanogram drop sizes with 3, 6, and 10 microsecond pulse widths respectively, then eight grayscale levels can be achieved: 0, 10, 20, 30, 40, 50, 60, and 70 ng. If a 50 ng drop were desired, the output channel would be enabled during the 3 and 10 microsecond pulses, but disabled during the 6 microsecond pulse.

In one operating mode, jets are sorted into groups based on a desired grayscale level. Each group is connected to a common output channel or enabler channel on the controller so that all of the jets in a group are enabled during the same pulse set to yield the desired grayscale level. This technique is most useful when there is high drop volume uniformity among the jets in the group, i.e., the drop volume difference between jets in the group is small when the jets are fired by the same pulse profile. A uniform drop volume among the jets in a group may be about ±10% when the jets are driven by the pulse profile that produces a maximum drop for a particular application.

Alternatively, differences in drop volume between jets fired by pulses of the same profile can be advantageously accommodated during grayscale control by selecting a pulse set for each ink-jet that provides the desired grayscale level. In this case, ink-jets may be sorted into groups of common sets of fire pulses by which the jets will be fired and then connected to a common output or enabler channel on the controller. The same pulse set will produce different volumes from the different jets but still in accordance with the desired grayscale level for each of the pixels. For example, Table II, below, includes the five pulse and drop mass relationships in Table I, with the addition of desired grayscale information.

TABLE II

| Fire pulse voltage | Drop mass in nanograms, jet 1 | Drop mass in nanograms, jet 2 |
|---|---|---|
| 107 | 84.8 | 90.6 |
| 102 | 79.6 | 85.0 |
| 97 | 74.6 | 79.8 |
| 92 | 69.7 | 75.2 |
| 87 | 64.7 | 70.2 |
| Desired grayscale | 145 | 145 |

If a grayscale level corresponding to about 145 ng is desired in both jet 1 and jet 2, the most desirable firing set for jet 1 would be the sum of a 92-volt and 97-volt pulse, and the most desirable firing set for jet 2 would be an 87-volt pulse and a 92-volt pulse. As apparent, the difference in drop volume between ink-jets can also be utilized to optimize and provide even finer grayscale resolution across the image.

The use of two, three or more fire pulses or enabling multiple fire pulses during a print cycle, while enhancing jet to jet uniformity and/or grayscale precision and range, may also increase the length of a print cycle. Increasing print cycle is suitable for many applications. For example, a printer may be provided with two (or more) user-selected operating modes that trade off print speed and quality. In a high resolution mode, drop variability volume is accommodated jet to jet and/or high precision grayscale control is provided. In a low (or lower) resolution mode, the number of fire pulses provided and/or enabled is reduced to provide lower print quality but faster printing. A specific application includes printing images from digital photography. A lower resolution image can be printed quickly to observe, e.g., composition and the like. A higher resolution image can be used for the final print.

Still further embodiments are in the following claims.

What is claimed is:

1. A method comprising generating ink drops during successive print cycles, determining a drop characteristic for a plurality of jets as a function of fire pulse profile, during a print cycle, delivering a series of fire pulses of different profiles to ink-jets of a print bead, and enhancing drop uniformity among the plurality of jets by enabling selected ones of the ink-jets in coordination with the occurrence of selected ones of the series of fire pulses during a print cycle to control at least one characteristic of drops that are jetted by the respective ink-jets.

2. The method of claim 1 in which the selected ones are all of the ink-jets in the print head.

3. The method of claim 1 in which the selected ones are fewer than all of the ink-jets in the print head.

4. The method of claim 1 in which the fire pulses of different profiles are delivered in sequence.

5. The method of claim 4 in which the same sequence is repeated in successive print cycles.

6. The method of claim 1 in which the profiles differ in voltage.

7. The method of claim 1 in which the profiles differ in duration.

8. The method of claim 1 in which the characteristic of the drops that is controlled comprises the drop volume.

9. The method of claim 1 in which the characteristic of the drops that is controlled comprises the drop velocity.

10. The method of claim 1 in which the fire pulses and ink-jets are selected to cause the volumes of drops jetted by the ink-jets in the print cycle to be essentially uniform.

11. The method of claim 1 in which the fire pulses and ink-jets are selected to cause the velocities of drops jetted by the ink-jets in the print cycle to be essentially uniform.

12. Apparatus comprising a print head having ink-jets, and a controller coupled to the print head and configured to (a) delivering, during a print cycle, a series of fire pulses of different profiles to ink-jets of a print head, and (b) based on the variation in a drop characteristic as a function of pulse profile for a plurality of ink-jets, enhancing drop uniformity among the plurality of jets by enabling selected ones of the ink-jets in coordination with the occurrence of selected ones of the series of fire pulses during a print cycle to control at least one characteristic of drops that are jetted by the respective ink-jets.

13. A method comprising positioning a substrate at successive locations relative to a print head having ink-jets for printing in a corresponding succession of print cycles, during each print cycle, delivering fire pulses of a series of different profiles to ink-jets of a print head, and enhancing drop uniformity among the plurality of jets by enabling selected ones of the ink-jets in coordination with the occurrence of selected ones of the series of fire pulses during a print cycle to control at least one characteristic of drops that are jetted by the respective ink-jets.

14. A method comprising associating values of a characteristic of drops jetted by an ink-jet in a print head with different profiles of fire pulses that yielded the drops for a plurality of ink-jets, and enhancing drop uniformity among said jets by controlling respective ink-jets to jet drops having desired values by selecting from different profiles of a series of fire pulses during a print cycle.

15. The method of claim 13 or 14 comprising enabling selected ones of the ink-jets in coordination with selected ones of the fire pulses in a manner that said selected ink-jets are enabled during multiple fire pulses within a print cycle.

16. The method of claim 15 wherein the characteristic of the drops controlled is the drop volume.

17. The method of claim 15 in which the selected ones are fewer than all of the ink-jets in the printhead.

18. The method of claim 15 in which the profiles differ in duration.

19. The method of claim 15 in which the same sequence is repeated in successive print cycles.

20. The method of claim 15 in which the profiles differ in voltage.

21. A method of controlling grayscale at individual ink-jets, comprising during a print cycle, delivering a series of fire pulses of different profiles to ink-jets of a printhead, said different profiles being associated with different ink volumes jetted by said ink-jets, selecting, separately for each ink-jet, from said fire pulses according to desired grayscale level at said each ink-jet, by determining the cumulative ink volume resulting from multiple fire pulses, and enabling selected ones of the ink-jets in coordination with the occurrence of the selected fire pulses to control the ink volume that is jetted by the respective ink-jets during the print cycle.

22. The method of claim 21 comprising determining the ink volume for multiple jets as a function of pulse profile.

23. A method of controlling grayscale, comprising during a print cycle, delivering fire pulses of different profiles to ink-jets of a printhead, said different profiles being associated with different ink volumes jetted by said ink-jets, selecting said fire pulses according to desired grayscale level by determining the cumulative ink volume resulting from multiple fire pulses, and enabling selected ones of the ink-jets in coordination with the occurrence of the fire pulses to control the ink volume that is jetted by the respective ink-jets during the print cycle, comprising sorting jets into a group of common grayscale level and enabling said group during common fire pulses.

24. The method of claim 23 wherein the drop volume difference between jets in said group is about ±10% or less.

25. The method of any one of claims 21–24 comprising delivering at least three fire pulses.

26. The method of any one of claims 21–24 comprising enabling at least two fire pulses.

27. Apparatus comprising a printhead having ink-jets, and a controller coupled to the printhead and configured to (a) deliver a series of fire pulses of different profiles to multiple ink-jets of a printhead during a print cycle, said different profiles being associated with different ink volumes jetted by said ink-jets, (b) selecting, separately for each ink-jet, a set of said fire pulses from said series corresponding to said desired grayscale level for each said ink jet, by determining the cumulative ink volume resulting from multiple fire pulses, and (c) enabling selected ones of the ink-jets in coordination with the occurrence of the selected one or more of the fire pulses in the set to control the ink volume jetted by the respective ink-jets during the print cycle.

* * * * *